United States Patent [19]

Moriconi

[11] 4,073,227

[45] Feb. 14, 1978

[54] TRASH COMPACTOR

[75] Inventor: Dario J. Moriconi, Orange Park, Fla.

[73] Assignees: Raymond L. Sperry; Selma Sperry, both of Jacksonville, Fla.

[21] Appl. No.: 733,063

[22] Filed: Oct. 18, 1976

[51] Int. Cl.[2] ..... B30B 15/14; B30B 15/28

[52] U.S. Cl. ..... 100/52; 100/229 A; 100/288; 141/73

[58] Field of Search ..... 100/52, 229 A, 288; 53/124 B; 141/73, 80

[56] References Cited

U.S. PATENT DOCUMENTS

| | | | |
|---|---|---|---|
| 1,197,824 | 9/1916 | Hess | 100/288 |
| 1,445,744 | 2/1923 | Brackett | 100/288 X |
| 2,757,603 | 8/1956 | Wilson et al. | 100/288 X |
| 3,527,161 | 9/1970 | Brown et al. | 100/229 A X |
| 3,611,673 | 10/1971 | Carkhuff | 100/229 A X |

*Primary Examiner*—Christopher K. Moore
*Attorney, Agent, or Firm*—McGlynn and Milton

[57] ABSTRACT

A trash compactor assembly including a cabinet supported upon a tubular framework and having an access opening in its front. A trash guide chute is disposed within the cabinet adjacent the opening for directing trash disposed therein downwardly so that it falls into a trash receptacle. The receptacle rests upon a base which is, in turn, connected to reaction arms which extend upwardly along the sides of the interior of the cabinet. The reaction arms support racks which are in meshing engagement with pinion gears connected to the respective ends of a shaft which is rotatably supported in a U-shaped drive frame. The U-shaped drive frame is slidably disposed within a box-like ram which is, in turn, suspended from the drive frame. Elastomeric blocks are disposed between the bottom of the drive frame and the bottom of the ram for compressing as the ram reaches a predetermined reaction force from the trash being compacted in the receptacle to provide a control signal. A drive motor and a gear drive train are supported on the drive frame for rotating the shaft which, in turn, rotates the pinions to move the drive frame and ram up and down relative to the reaction arms.

17 Claims, 6 Drawing Figures

TRASH COMPACTOR

The subject invention relates to an improved trash compactor assembly.

Trash compactors are widely used in the home for compressing trash. Trash compactors are also widely utilized commercially in apartment buildings, factories, and the like. There are numerous trash compactor assemblies available which include features responsive to the particular environment in which the assembly is to be used. There is, however a need for a trash compactor for use in commercial establishments which serve the public and generate a great deal of trash. Typical of such an establishment is a fast food restaurant. Another example would be an amusement park. A trash compactor suitable for replacing the various trash receptacles now used in such establishments must be inexpensive and durable because a large number would be required and they would experience extensive use by the public.

The subject invention provides a trash compactor including a novel combination of components which is simplified in structure so as to be inexpensive, yet is durable to prevent maintenance problems. Although the trash compactor of the subject invention resulted from an effort to provide a compactor which fulfills the needs of establishments directly serving the public, the compactor may also be utilized in all other environments where compactors are needed.

In accordance with the subject invention, there is provided a trash compactor including a base for supporting a trash receptacle with reaction arms connected to and extending upwardly from each side of the base. A drive frame means is disposed between the arms and a drive motor is supported on the drive frame means with a drive train means interconnecting the motor and the arms for supporting the frame means on the arms and for moving the frame means relative the arms in response to the operation of the motor. In addition, a ram means is suspended from the drive frame means for insertion into the trash receptacle for compressing trash therein and a lost motion connection means interconnects the ram means and the frame means for allowing a predetermined amount of lost motion between the ram means and the frame means as the ram means applies a predetermined force to trash in the receptacle.

Typical of compacting assemblies known in the prior art and regarded to be the most pertinent to the subject invention are illustrated in the following U.S. Pat. Nos.: 2,622,511 granted Dec. 23, 1952 to T. W. Marisco et al.; 3,734,009 granted May 22, 1973 to Einar O. Engerbretsen; 3,786,744 granted Jan. 22, 1974 to Frank E. Miller, et al. and 3,901,139 granted Aug. 26, 1975 to Dario J. Moriconi.

All of the advantages of the present invention will be readily appreciated as the same becomes better understood by reference to the following detailed description when considered in connection with the accompanying drawings wherein.

Referring to the drawings wherein like numerals indicate like or corresponding parts throughout the several views, an improved trash compactor assembly constructed in accordance with the instant invention is generally shown at 10.

Figure 1:
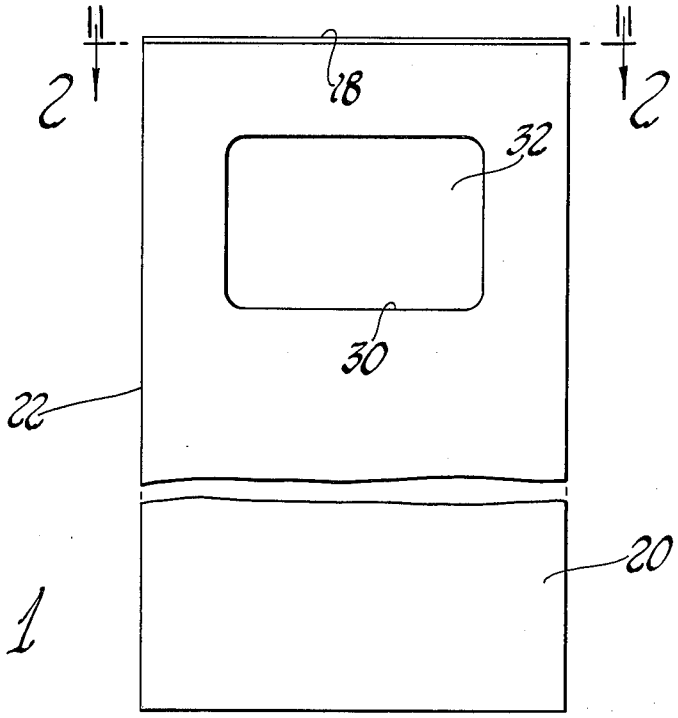
FIG. 1 is a front elevational view of a trash compactor constructed in accordance with the subject invention.
Figure 2:
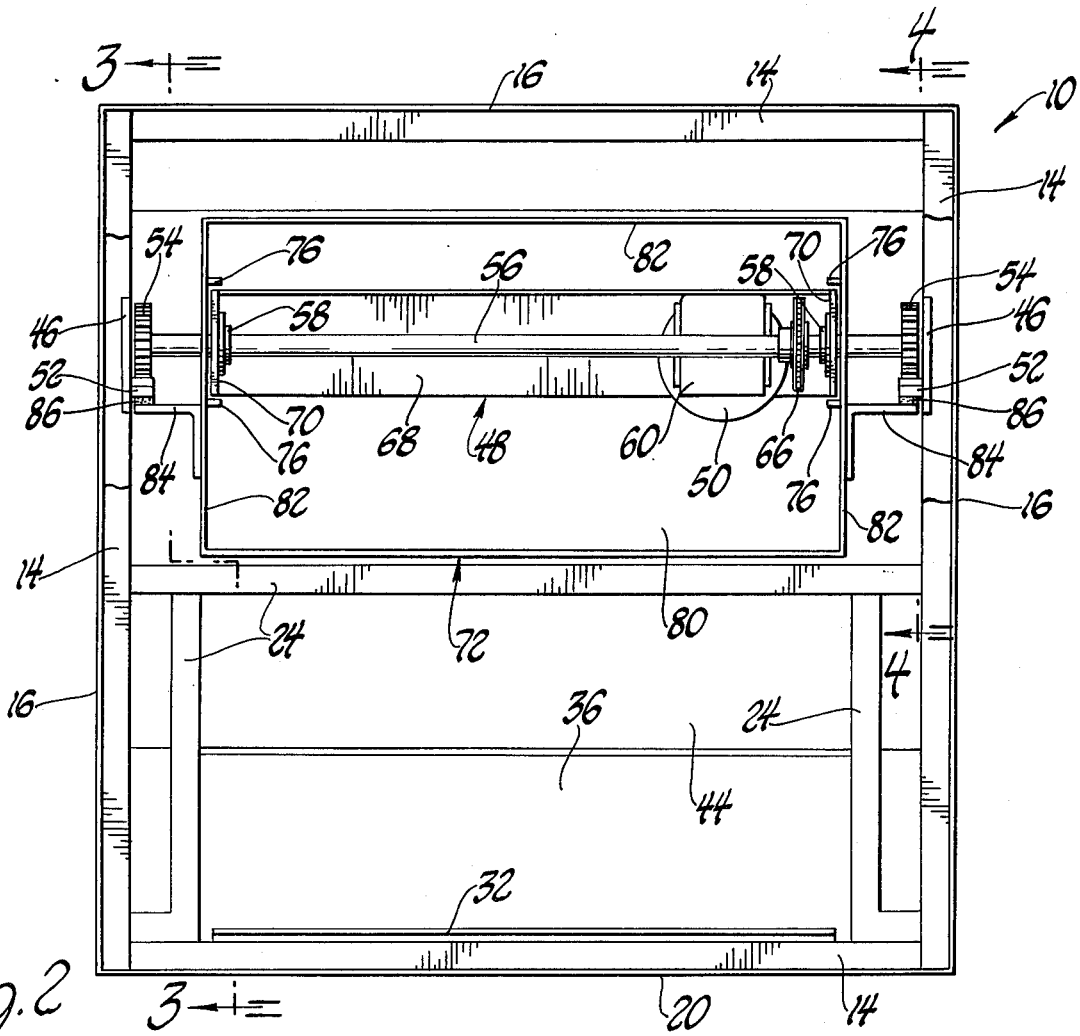
FIG. 2 is a view taken substantially along line 2—2 of FIG. 1 just below the top sheet of the cabinet.
Figure 3:
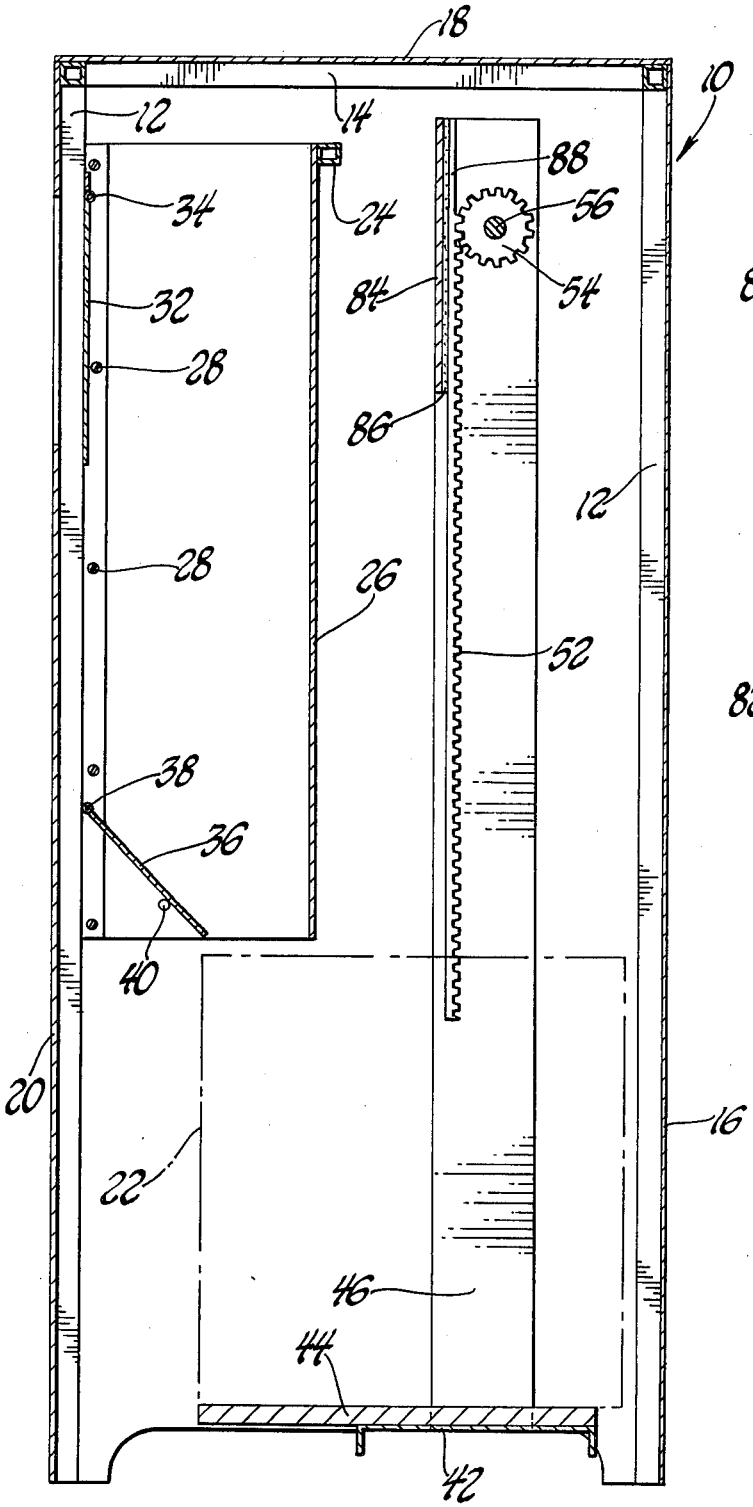
FIG. 3 is a cross sectional view taken substantially along line 3—3 of FIG. 2.

The trash compactor includes a cabinet including a skeleton frame of tubular members 12 and 14. The tubular members 12 are disposed at the four corners of the cabinet and extend longitudinally upwardly from the bottom of the cabinet and support the upper members 14. An appropriate skin or paneling 16 is supported on the frame members 12 and 14. Although not shown in FIG. 2, a similar sheet or panel 18 defines the top of the cabinet. The front of the cabinet is defined by a door 20 which is hinged along the edge 22. The door 20 may be opened for removal of a trash receptacle which is indicated in phantom at 22 in FIG. 3.

The cabinet also includes the tubular support members 24 which support a sheet metal trash guide or chute. The sheet metal trash chute 26 is U-shaped in configuration and is secured to the cabinet by the fasteners 28. The front door 20 includes an excess opening 30 and a door panel 32 covers the opening 30 and is hinged to the cabinet by a hinge 34. The door panel 32 is pivotted open as trash is deposited within the assembly. A baffle plate 36 is disposed within the trash chute 26 and is supported on the sides of the chute 26 by hinge connections 38. The baffle plate 36 is supported on pins 40 which extend from the opposite sides of the chute 26 and may be pivotted upwardly from the pins for removing the receptacle 22. The plate 36 directs trash into the receptacle 22.

The trash receptacle 22 is supported on a base defined by the channel member 42 and the support plate 44. A pair of reaction arms 46 are connected to and extend upwardly from the opposite sides of the channel member 42 of the base. The channel member 42 is preferably made of metal and the arms 46 are also made of metal and welded to the channel member 42. The support plate 44 is connected to the channel member 42 by fasteners, or the like.

A drive frame means, generally indicated at 48, is disposed between the arms 46 and a drive motor 50 is supported on the frame means 48.

A drive train means operatively interconnects the motor 50 and the arms 46 for supporting the frame means 48 on the arms 46 and for moving the frame means 48 relative to the arms 46 in response to operation of the motor. More specifically, the drive train means includes a gear rack 52 secured to each of the arms 46 and extending longitudinally thereof. The drive train means also includes pinion gears 54 which are in meshing engagement with the racks 52. The drive means further includes a shaft 56 which is rotatably supported in bearings 58 on the drive frame means 48. The pinions 54 are secured to the respective ends of the shaft 56. Also included is a gear drive means comprising a gear box 60, the drive sprockets 62 and 64, and the drive chain 66 for transmitting rotational motion from the motor 50 to the shaft 56.

The drive frame means 48 comprises a U-shaped frame with a bottom 68 and a pair of spaced parallel legs 70 extending upwardly from the bottom 68. The bearings are secured to the legs 70 whereby the shaft 56 is rotatably supported by the drive frame means 48. The drive shaft 56 is rotatably supported by the legs 70 at a position which is spaced well above the bottom 68.

The assembly also includes a ram means generally indicated at 72. The ram means is suspended from the drive frame means 48 for insertion into the trash receptacle 22. A lost motion connection means interconnects the ram means 72 and the drive frame means 48 for allowing a predetermined amount of lost motion between the ram means 72 and the drive frame means 48 as the ram means 72 applies a predetermined force to trash in the receptacle 22. More specifically, the lost motion means includes a pair of openings or elongated slots 74 which surround the shaft 56 in spaced relationship thereto. Normally, the upper ends of the slots 74 engage the shaft 56 for suspending the ram means 72 from the shaft 56 and, hence, from the drive frame means 48. The lost motion means also includes track means defined by the track bars 76 secured to the inside walls of the ram means 72 for engaging the side edges of the legs 70 of the drive frame means 48 for limiting movement of the ram means 72 relative to the drive frame means 48 to rectlinear or vertical movement. The lost motion means also includes yieldable means comprising the blocks of elastomeric material 78 disposed between the bottom 68 of the drive frame means and the bottom of the ram means. The blocks 78 yield in response to a predetermined force as the ram means 72 engages trash in the receptacle 22 to allow the lost motion between the drive frame means 48 and the ram means 72. In other words, the drive frame means 48 continues to move downwardly relative to the ram means 72 to compress the elastomeric blocks 78 when the ram means 72 stops moving downward in response to a predetermined reactive force.

The ram means 72 is a box-like structure having an open upper end including a bottom ram plate 80 which is disposed below the bottom 68 of the drive frame means 48. The elastomeric blocks 78 are secured to the bottom 68 of the drive frame means and are disposed between the bottom member 68 and the bottom ram plate 80 of the ram means 72. The ram means 72 includes a plurality of sides 82 extending upwardly from the bottom ram plate 80. The box-like structure defining the ram means 73 is preferably fabricated of metal and may include a frame. The elongated slots 74 are disposed in opposite sides 82 of the rectangular box-like ram means 72.

Guide plates defined by the L-shaped channel members 84 are secured to opposite sides 82 of the ram means 72 by bolts or similar fasteners. The members 84 support pads of plastic antifriction material 86 which, in turn, are in sliding engagement with the rack members 52 for guiding or limiting movement of the ram means 72 and, hence, the drive frame means 48, to rectlinear or vertical movement relative to the arms 46. In addition, the guide plates 84 assure that the pinions 54 mesh with the racks 52. The upper ends of the racks 52 are recessed or devoid of teeth, as shown at 88, thereby providing an upper limit of movement of the pinions 54 therealong.

Figure 4:
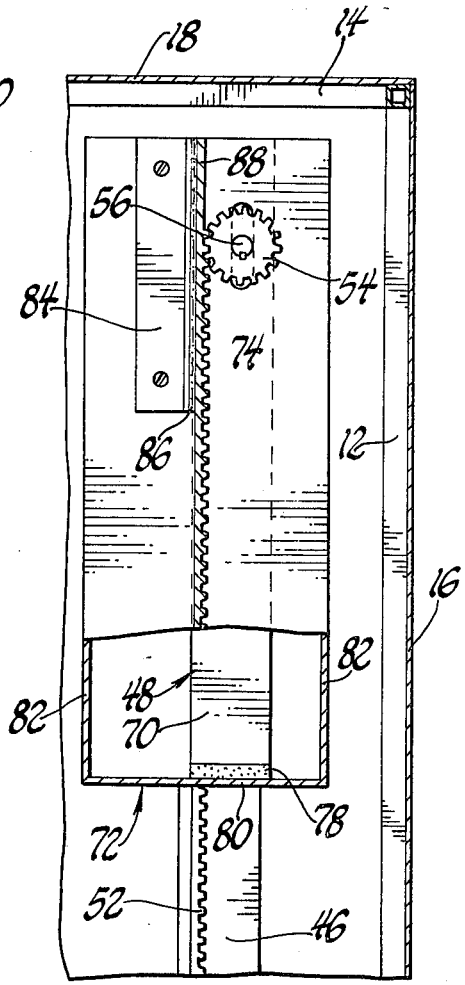
FIG. 4 is a fragmentary cross sectional view taken substantially along line 4—4 of FIG. 2.
Figure 5:
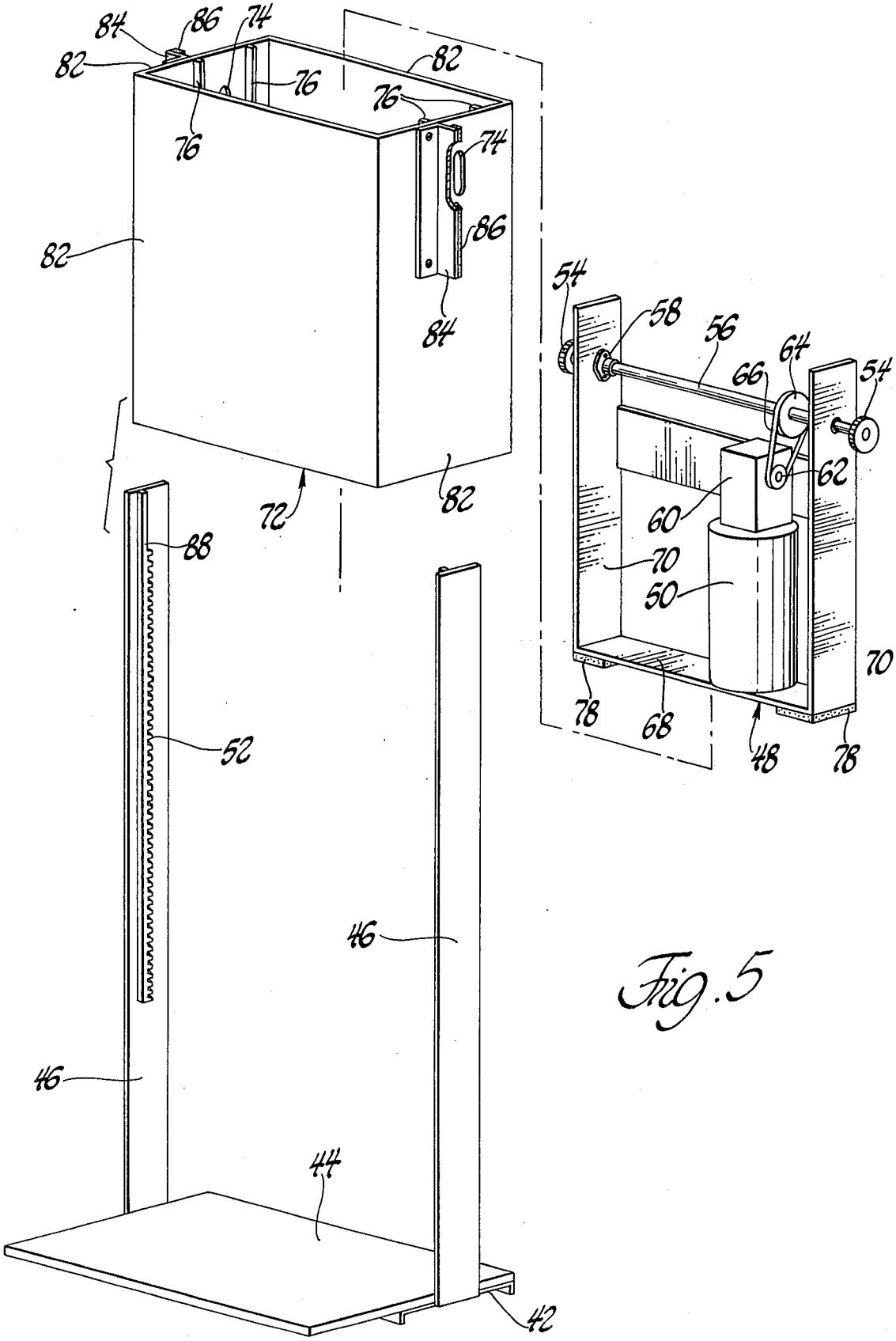
FIG. 5 is an exploded perspective view showing the basic components of the trash compactor.

Initially, the assembly is in the position illustrated in FIG. 4 and, upon operation of the motor 50, the shaft 56 is rotated to rotate the pinions 54 which move the assembly vertically downwardly whereby the ram means 72 enters the receptacle 22. When the ram means 72 is subjected to a predetermined force sufficient to compress the elastomeric blocks 78 there is a lost motion between the frame means 48 and the ram means 72. In other words, when a sufficient force or reaction force is applied to the ram means 72, the motor continues to operate to compress the blocks 78 and an appropriate switch or sensing device senses that lost motion and reverses the motor 52 so that the entire assembly moves vertically upwardly to the initial position.

Figure 6:
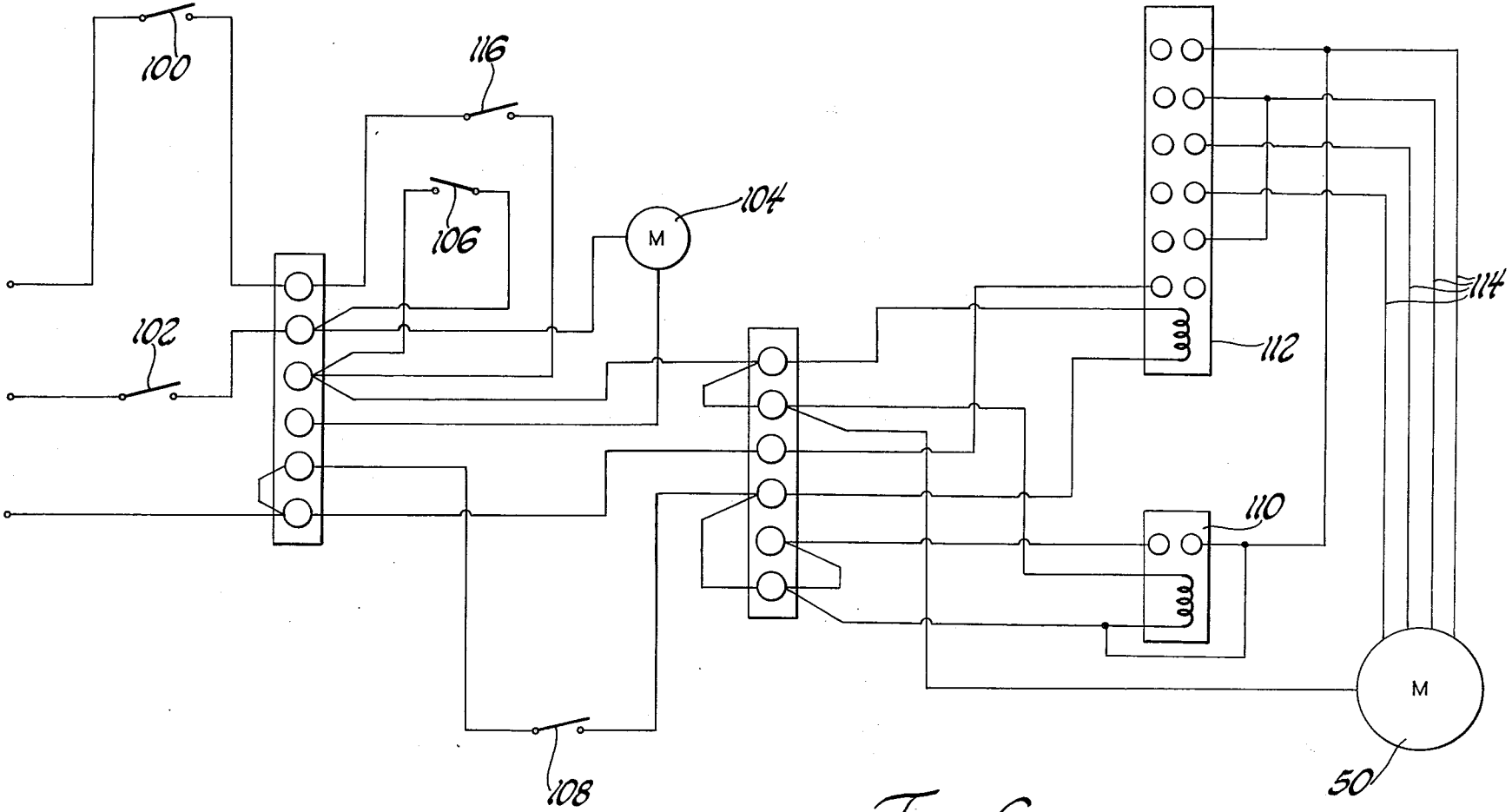
FIG. 6 is a schematic view showing a control circuit for controlling the operation of the trash compactor.

FIG. 6 is a schematic view of a sequencing or control means which may be utilized for operating the assembly. Initially, power to the entire assembly is off until the latch for the cabinet door 20 is closed thereby activating a switch 100. Preferably, a photocell is disposed within the trash guide 26 and is activated each time trash falls into the receptacle 22. Such a photocell activates a switch 102. The switch 102, when closed as trash is falling, will provide current to a small stepping motor 104. The stepping motor 104 will rotate a cam, or the like, to control a switch 106. The cam will be defined such that when a predetermined amount of trash has been dropped into the receptacle 22 to cause the stepping motor to rotate a predetermined amount, the switch 106 will be closed. When the switch 106 is closed, the motor 50 is energized to rotate the pinions 54 so as to move the drive frame means 48 and the ram means 72 downwardly into the trash receptacle 22.

When the ram means 72 has compacted the trash within the receptacle 22 to a sufficient pressure, the ram means 72 discontinues downward movement and the yieldable blocks 78 are compressed as the bottom 68 of the frame means 48 continues to move downwardly with respect or relative to the ram means 72. The elongated slots 74 allow the shaft 56 to move downwardly during such relative movement between the drive frame means 48 and the ram means 72. A micro switch 108, or the like, senses such relative movement between the drive frame means 48 and the ram means 72 to energize a relay 110 which, in turn, energizes relay 112. The switch 108 is preferably disposed on the ram means 72 and coacts with a projection on the drive frame means 48. The relay 110 cuts out one of the lines 114 to the motor 50 and inserts or actuates one of the other lines 114 to reverse the direction of rotation of the motor 50. The reversal of the rotation of the motor 50 causes the entire drive frame means 48 and ram means 72 to move upwardly rectlinearly along the arms 46 to the initial position illustrated in FIG. 4. A switch 116 disposed on one of the arms 46 is opened when the assembly returns to the initial position to cut all of the power to the large motor 50. Thereafter, a second cycle may be repeated. In the event of a malfunction of the switch 116, the pinions will reach the non-gear teeth portions 88 of the racks 52 and will not continue upward movement. Of course, if the cabinet door 20 is opened to remove the receptacle 22, the switch 100 is opened, thereby preventing any operation of the assembly.

It is important to note that the reaction in compressing trash within the receptacle 22 is against the base members 42 and 44, through the arms 46 to the ram means 72. There is, therefore, no structure required in the actual cabinet surrounding the assembly and the cabinet may therefore be made of very light nonstructural or load-carrying materials.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. An improved trash compactor assembly comprising; a base for supporting a trash receptacle, a reaction arm connected to and extending upwardly from two opposite sides of said base, a drive frame disposed between said arms, a drive motor supported on said frame, drive train means operatively interconnecting said motor and said arms for supporting said frame on said arms and for moving said frame longitudinally of said arms in response to operation of said motor, ram means suspended from said drive frame for insertion into the trash receptacle, and lost motion connection means interconnecting said ram means and said frame for allowing a predetermined amount of lost motion between said ram means and said frame when the force applied to trash in the receptacle by said ram means reaches a predetermined value.

2. An assembly as set forth in claim 2 wherein said lost motion connection means includes track means interconnecting said frame and said ram means for limiting movement of said ram means relative to said frame to rectilinear movement.

3. An assembly as set forth in claim 2 wherein said lost motion connection means includes yieldable means disposed between said frame and said ram means for yielding in response to said predetermined force to allow said lost motion therebetween.

4. An assembly as set forth in claim 3 wherein said drive train means includes a rack secured to each of said arms and a pinion engaging each of said racks and supported by said frame.

5. An assembly as set forth in claim 4 including guide means extending from said ram means and in sliding engagement with at least one of said racks for guiding movement of said ram means and said frame rectlinearly relative to said arms.

6. An assembly as set forth in claim 5 wherein said drive train means includes a shaft rotatably supported by said frame, said pinions being secured to the ends of said shaft.

7. An assembly as set forth in claim 6 wherein said lost motion means includes at least one slot in said ram means surrounding said shaft and in spaced relationship thereto.

8. An assembly as set forth in claim 7 wherein said drive train means includes a gear drive means interconnecting said motor and said shaft.

9. An assembly as set forth in claim 7 wherein said frame comprises a U-shaped frame with a bottom and a pair of spaced parallel legs extending upwardly therefrom.

10. An assembly as set forth in claim 9 wherein said shaft is rotatably supported in said legs at a position spaced above said bottom.

11. An assembly as set forth in claim 10 wherein said ram means includes a bottom ram plate disposed below said bottom of said frame and spaced therefrom.

12. An assembly as set forth in claim 11 wherein said yieldable means is disposed between the bottom of said frame and said bottom ram plate.

13. An assembly as set forth in claim 12 wherein said ram means includes a plurality of sides extending upwardly from said bottom ram plate.

14. An assembly as set forth in claim 13 wherein said slots are disposed in opposite sides of said ram means.

15. An assembly as set forth in claim 14 including sequencing means for sensing said lost motion between said ram means and said frame for controlling the operation of said motor.

16. An assembly as set forth in claim 14 including cabinet means extending upwardly from said base along said arms and defining an enclosure.

17. An assembly as set forth in claim 4 wherein each of said racks terminate in an upward extremity adjacent a recess in which said pinions may freely rotate without causing upward movement of said frame.

* * * * *